United States Patent [19]

Stahlecker

[11] 4,183,201

[45] Jan. 15, 1980

[54] OPEN-END SPINNING MACHINE WITH MEANS FOR CATCHING AND REMOVING SEPARATED DEBRIS

[75] Inventor: Fritz Stahlecker, Bad Überkingen, Fed. Rep. of Germany

[73] Assignees: Fritz Stahlecker; Hans Stahlecker, both of Fed. Rep. of Germany

[21] Appl. No.: 860,093

[22] Filed: Dec. 13, 1977

[30] Foreign Application Priority Data

Dec. 24, 1976 [DE] Fed. Rep. of Germany ..... 2658752

[51] Int. Cl.[2] ..... D01H 11/00; D01H 1/12

[52] U.S. Cl. ..... 57/301; 57/304; 57/306

[58] Field of Search ..... 57/58.89–58.95, 57/56, 300, 301, 302, 304, 306

[56] References Cited

U.S. PATENT DOCUMENTS

| | | | |
|---|---|---|---|
| 396,616 | 1/1889 | Sharples | 57/56 |
| 708,061 | 9/1902 | Mock et al. | 57/56 |
| 3,884,028 | 5/1975 | Stahlecker et al. | 57/56 |
| 3,922,839 | 12/1975 | Sakurai et al. | 57/56 X |
| 3,924,397 | 12/1975 | Stahlecker et al. | 57/56 |
| 3,959,961 | 6/1976 | Stahlecker | 57/56 |
| 3,986,327 | 10/1976 | Kobayashi | 57/56 |
| 3,986,328 | 10/1976 | Harrap | 57/56 |
| 4,016,004 | 4/1977 | Koella | 57/56 X |
| 4,028,136 | 6/1977 | Kamp | 57/56 X |
| 4,057,955 | 11/1977 | Roehrich | 57/56 |
| 4,069,654 | 1/1978 | Roehrich | 57/56 |

FOREIGN PATENT DOCUMENTS

| | | | |
|---|---|---|---|
| 2351825 | 4/1975 | Fed. Rep. of Germany | 57/56 |

*Primary Examiner*—John Petrakes

*Attorney, Agent, or Firm*—Craig and Antonelli

[57] ABSTRACT

Apparatus is provided for removing debris and for cleaning components of spinning assemblies of an open-end spinning machine of the type having a plurality of spinning assemblies arranged side-by-side and including shedding devices for shedding debris from the fibrous material to be spun. In order to accommodate changing configurations of collecting openings and other structure of the spinning assemblies, the component cleaning elements are provided separately exchangeable and/or adjustable with respect to the debris removing structures. Various preferred embodiments are provided, including embodiments with conveyor belts for removing debris from a plurality of collecting openings at the respective spinning assemblies, with cleaning elements being carried by the conveyor belts and being disposed so as to clean guide surfaces at the respective collecting openings. Other embodiments include movable scrapers running along a channel which accepts the debris from the collecting openings.

27 Claims, 17 Drawing Figures

1
2
11
5
6
8
10
12
13
9
7
24
15
23
14
16
20
21
17
22
19
18
4
3

OPEN-END SPINNING MACHINE WITH MEANS FOR CATCHING AND REMOVING SEPARATED DEBRIS

BACKGROUND AND SUMMARY OF THE INVENTION

The invention relates to an open-end spinning machine with a plurality of spinning assemblies arranged side by side, said assemblies being provided with devices for separating debris from staple, said staple being fed to the spinning rotors of the spinning assembly in an opened state, said rotors each having at least one collecting opening for debris in the transport path of the opened staple, associated with means for catching and removing the debris, said means extending over at least a part of the spinning assemblies along the length of the machine and associated with cleaning elements to clean the vicinity of the collecting openings of the spinning assemblies.

It is known (German Offenlegungsschrift No. 2,356,180, corresponding U.S. Pat. No. 3,924,397) to dispose a conveyor belt beneath the collecting openings of the spinning assemblies, said belt running along the length of the machine, said belt further collecting and removing the debris. Guide surfaces are provided between the collecting openings and the conveyor belt, said surfaces guiding the debris shed from the collecting openings in such manner that the debris lands on the conveyor belt located therebelow. In order to prevent tufts composed of accumulated debris and fibers from forming in the vicinity of the collecting openings in the course of time, said debris and fibers being capable of being sucked back into the vicinity of the opening roller and considerably interfering with the spinning operation, a brush-like cleaning element is disposed on the conveyor belt, bristles of said element extending into the vicinity of the collecting opening.

It is also known (German Offenlegungsschrift No. 2,438,538) to provide a collecting chamber behind a collecting opening, said chamber being emptied at intervals pneumatically or mechanically by a cleaning device traveling along the open-end spinning machine. This cleaning device is also provided with means by which other areas in the vicinity of the collecting opening may be cleaned.

A goal of the invention is to provide appropriate cleaning elements for cleaning the components of the spinning assemblies, said elements being located in the vicinity of the collecting openings, whereby provision is made for the cleaning devices to be able to be adjusted to the special requirements of the staple to be processed. This goal is achieved by virtue of the fact that a plurality of cleaning elements are provided which are independent and/or separable from the means for catching and removing the debris, said cleaning elements being associated with at least one component of the spinning assemblies and/or the means for catching and removing the debris.

This design makes it possible to adjust the shape and effect of the required cleaning elements so that they are exactly correct for the existing conditions.

These and further objects, features and advantages of the present invention will become more obvious from the following description when taken in connection with the accompanying drawings which show, for purposes of illustration only, several embodiments in accordance with the present invention.

DETAILED DESCRIPTION OF THE INVENTION

Figure 1:
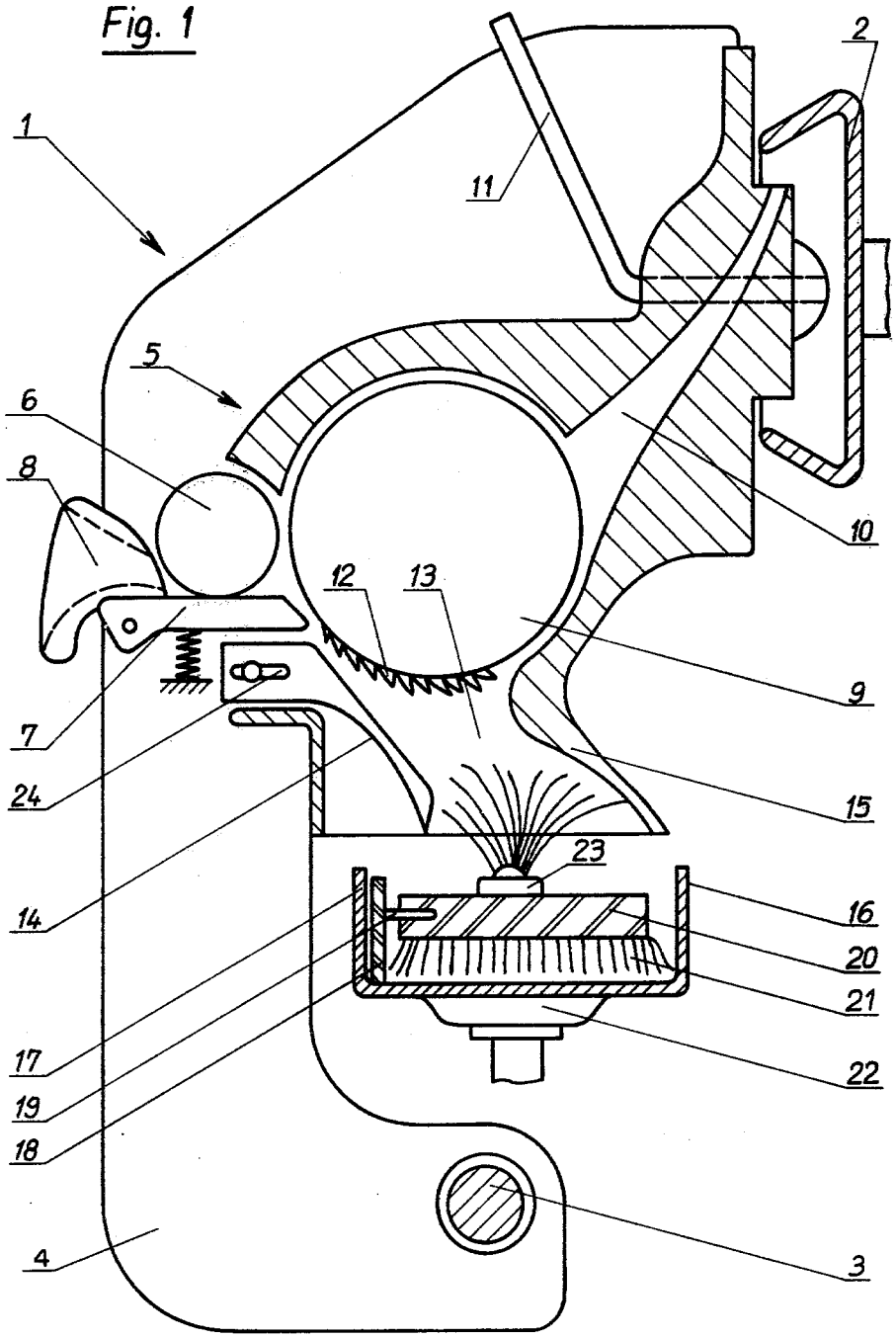
FIG. 1 is a schematic sectional view through an open-end spinning assembly, provided with devices for collecting debris as well as means for catching and removing the debris, associated with independent cleaning elements, constructed in accordance with a preferred embodiment of the invention.

In the embodiment according to FIG. 1, a housing 4 swivelable about a stationary axis 3 is associated with a spinning rotor 2, said rotor being rotatably mounted in a stationary fashion in a housing, not shown. Housing 4 contains devices 5 for feeding and opening a sliver to be spun in spinning rotor 2. Devices 5 comprise a feed device for the card sliver, consisting of a feed roller 6, feed table 7, and feed funnel 8, said sliver being fed to a rapidly turning opening roller 9, beyond which the individual fibers to be opened are fed to spinning rotor 2 through a fiber feed channel 10, whence the spun yarn is pulled off by a yarn pulloff channel 11. Opening roller 9 is provided on its circumference with equipment 12, shown only partially, which can consist of teeth, needles, or the like, and which on the one hand opens the card sliver fed to it into individual fibers and on the other hand ejects debris in the card sliver through a collecting opening 13. The debris is fed through guiding surfaces 14, 15 to a channel 16 which collects the debris and extends along the length of the machine, said channel 16 having a U-shaped cross section and being open at the end facing the collecting openings of the adjacent spinning assemblies 1. A belt-like transport means 18 is provided along one side wall 17 of channel 16, the guide means of said transport means 18 not being shown in FIG. 1. Pushers 19, in the form of pins, are mounted on this transport means 18 at fixed intervals which correspond to the spaces between two or more spinning assemblies 1, with a cleaning element 20 being mountable on each pusher. This cleaning element 20 moves along with transport means 18, as will be described in detail hereinbelow, along the length of the machine.

Cleaning element 20 is shown in FIG. 1 in the vicinity of collecting opening 13, but this drawing is meant to show that this cleaning element 20 is associated with a spinning assembly 1 only at specific periodic intervals. Thus, in the normal operating state, the debris spun off opening roller 9 can fall directly into channel 16. Cleaning element 20 is designed in the form of a brush 21 on its underside, the bristles of said brush pushing the collected debris in channel 16 ahead of them as they move along the length of the machine driven by transport means 18 in the manner of a sweeping brush, until the debris comes into the vicinity of a suction device, for which a plurality of connections 22 are provided at regular intervals along the bottom of channel 16. A removable cleaning means 23 is mounted on the upper side of cleaning element 20, said cleaning means wiping guide surfaces 14 and 15 of spinning assembly 1 as transport means 18 moves along the length of the machine. The combination of stationary channel 16 with the cleaning element 20 separably disposed thereon makes it possible to clean both guide surfaces 14 and 15 as well as channel 16 with the same cleaning element 20. Moreover, due to the exchangeability of cleaning means 23, adjustments can be made for different kinds of guide surfaces 14, said surfaces, as shown in FIG. 1, being adjustable in the example shown by means of a slot connection 24. Depending on the position of guide surface 14, another cleaning means (differently configured brush or the like) 23 may be exchanged and used. It is also contemplated to provide transport means 18 with control cams which briefly open the normally closed connection 22 at the appropriate time, when cleaning element 20 is in the vicinity of connection 22 of the suction device. This makes it possible to ensure that the condition of the air in the vicinity of opening roller 9 is normally not disturbed by the suction. In addition to the connections 22 disposed at intervals for the suction device, additional suction tubes (not shown) are preferably mounted along the lengths of the spinning machine to clean the cleaning means 23 as they pass them.

Figure 2:
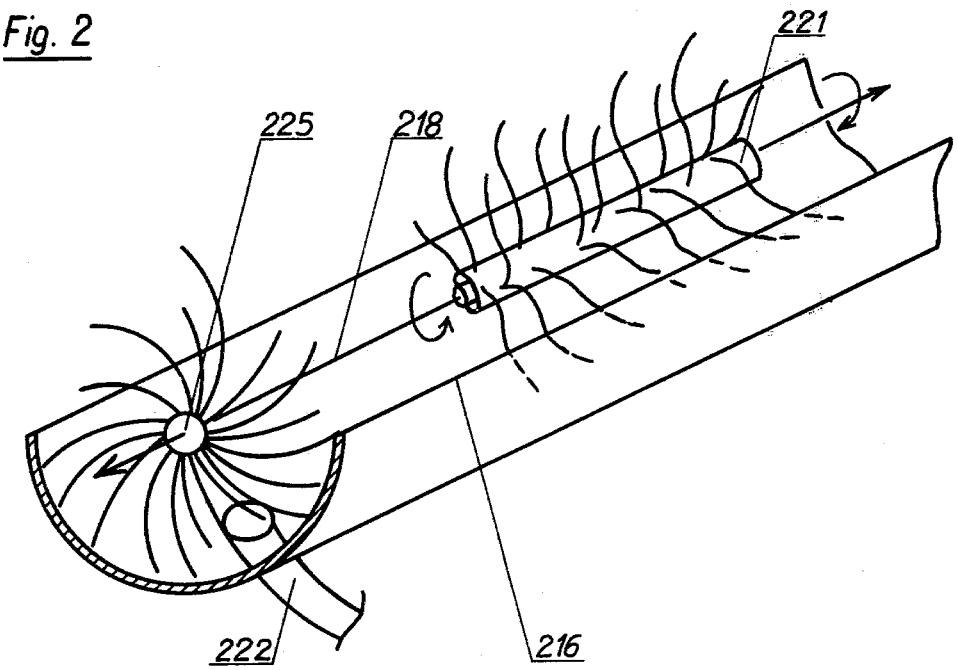
FIG. 2 is a partial schematic view of means for catching and removing debris, associated with collecting openings of spinning assemblies, constructed in accordance with another preferred embodiment of the invention.

FIG. 2 is a perspective view of the part of a channel 216 with a semicircular cross section. This channel 216 is associated with a transport means, preferably adjustable, in the form of a cable conveyor 218, to which various cleaning means 221 and 225, at intervals with respect to one another and combined into groups, are mounted as cleaning elements. It is also contemplated to provide an adjustable carriage within channel 216, guiding cable conveyor 218. The cleaning means 221 and 225 are associated with the channel 216 in a manner similar to that shown in FIG. 1, and simultaneously clean channel 216 and the guide surfaces (surfaces like guide surfaces 14, 15 in FIG. 1) not shown in FIG. 2. Connections 222 for suction devices are provided at one or more points on channel 216, said suction devices serving to remove the debris after it has been pushed into their vicinity. The advantage of the arrangement according to FIG. 2 is that cleaning means 221, 225 for cleaning channel 216 as well as the guiding surfaces (at the collecting openings of the spinning assemblies) are made integral. The cleaning effect can be increased even further by rotation of cleaning means 221, 225. Owing to the stationary design of channel 216, the latter may be formed so that it is a part of the housing of the opening roller, so that the entire channel is composed of individual elements each of which corresponds to the length of one spinning assembly.

Figure 3:
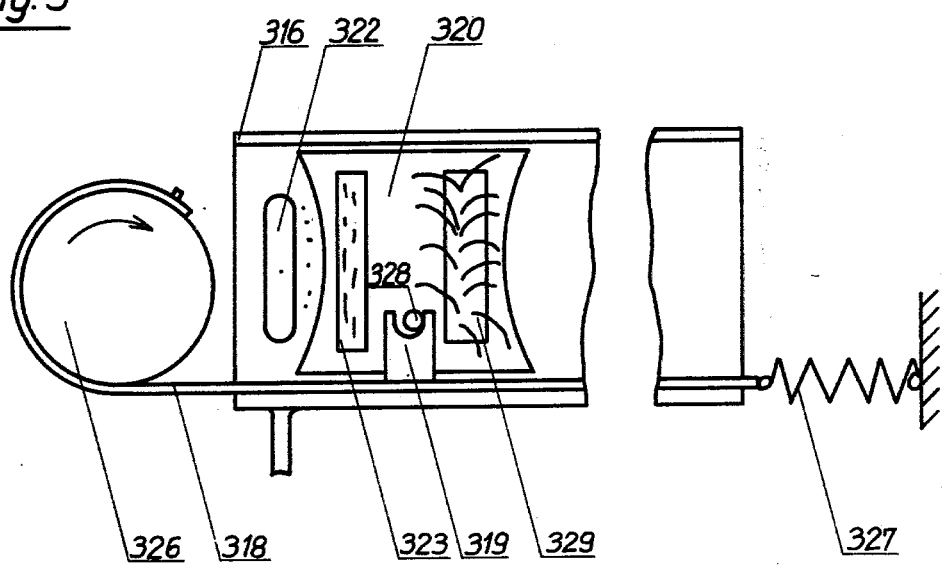
FIG. 3 is a top schematic view of a device for catching and removing debris with a component guided therein and supporting cleaning elements, constructed in accordance with another preferred embodiment of the invention.

FIG. 3 is a top view of a portion of a stationary channel 316. In this case, an adjustable belt 318 serves as the transport means for cleaning element 320, said belt being wound up at one end on a winding roller 326 periodically drivable in the direction indicated by the arrow, the other end of said belt being subject to the action of an extension spring 327. Belt 318 is provided with pushers 319 at fixed intervals, said pushers pushing cleaning elements 320 in the transport direction by means of pins 328 disposed therein. Cleaning elements 320 are preferably provided with a shovel-like carriage or scraper, which pushes the debris collected in channel 316 ahead of itself until the debris comes into the vicinity of a connection 322 for a suction device and is removed there. Several additional cleaning elements, namely cleaning means 323 and 329 of different designs are provided above cleaning elements 320 and clean the guide surfaces (not shown in FIG. 3) of the spinning assemblies but similar to those of FIG. 1. The design in FIG. 3 has the advantage that cleaning element 320 is formed by the carriage itself, whereby special guide means for transport means 318 are rendered superfluous, and wherein cleaning elements 320 and cleaning means 323, 329 are readily exchangeable.

Figure 4:
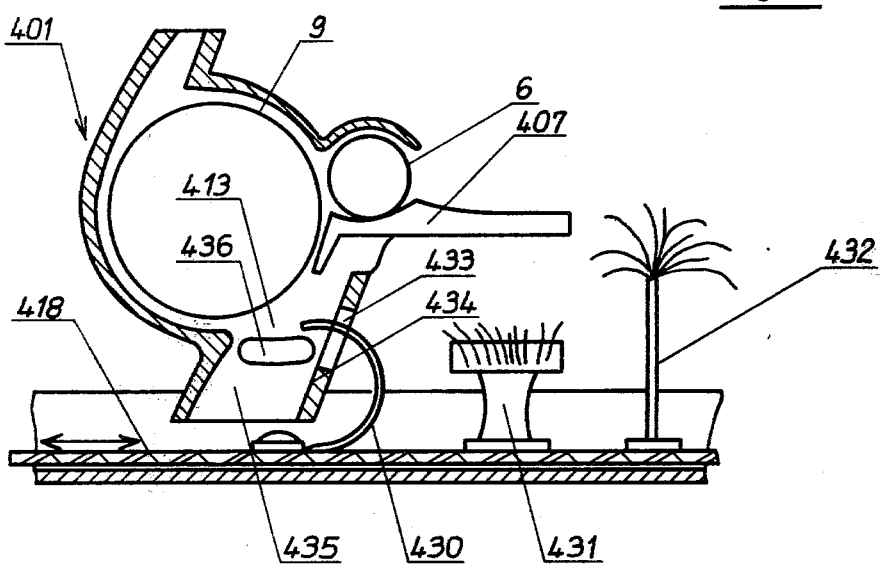
FIG. 4 is a schematic sectional view through portions of an open-end spinning assembly, wherein a group of different cleaning elements are disposed on a conveyor belt, said belt serving as a device for removing the debris, constructed in accordance with another preferred embodiment of the invention.

FIG. 4 is another schematic representation of the cross section of an open-end spinning assembly 401 in the vicinity of feed roller 6 and opening roller 9, whereby a tangential belt 418 is provided below the collecting opening 413 as a transport means for the cleaning elements, said belt simultaneously serving as a debris-collecting means. This preferably adjustable tangential belt 418 is provided with a plurality of cleaning elements 430, 431, and 432, said elements being arranged in a row, combined into a group, and having different designs, said elements all being removable and therefore replaceable on tangential belt 418 and being adjustable with respect to the various components of spinning assembly 401. Cleaning element 430 is a flexible element bent into a semicircle, said element being capable of passing through a bore 433 in a guide surface 434 as it is transported to the left, whereby debris can also be wiped out of the bore which serves to supply air. As soon as tangential belt 418 has moved further to the left, cleaning element 430 is bent to the right due to its flexibility so that it is pulled out of bore 433 again. The second cleaning element 431 is disposed offset slightly sideways with respect to cleaning element 430, so that it wipes laterally behind wall 435 and can clean recess 436. Cleaning means 432, finally, can clean the area of feed roller 6 and feed table 407. Cleaning elements 430, 431, and 432, separable from tangential belt 418, clean all of the reachable parts of spinning assembly 401. Since tangential belt 418 simultaneously constitutes the debris-collecting means, additional devices must be provided to remove the debris, for example suction devices which remove the debris from the tangential belt. Of course, it is also contemplated to provide the arrangement according to FIG. 4 with a stationary channel along which a transport means for the cleaning elements may be guided, independently of said channel.

Figure 5:
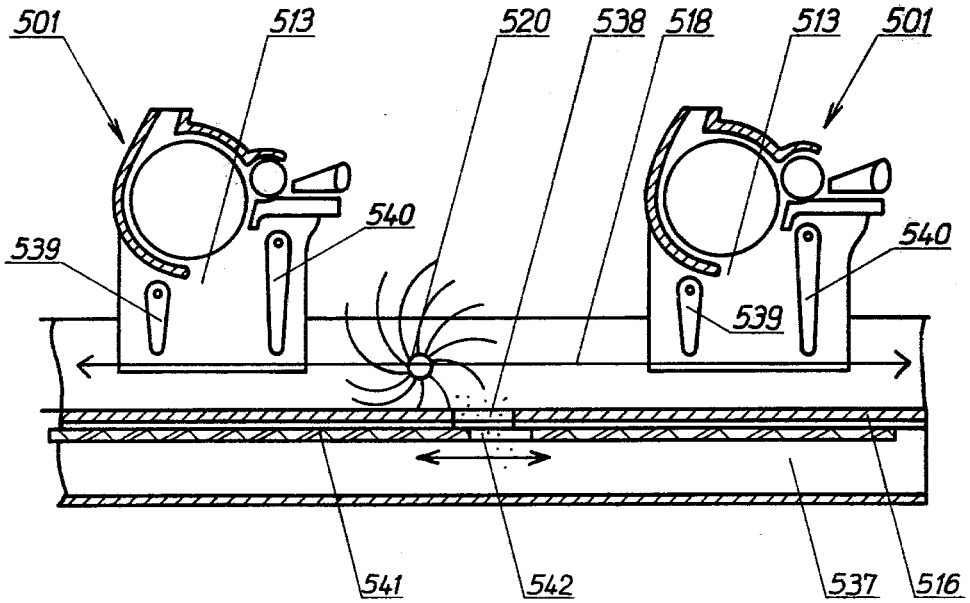
FIG. 5 is a sectional view similar to FIG. 4, showing another preferred embodiment with a different arrangement of cleaning elements and with a provision for intermittent connection of a vacuum device.

FIG. 5 shows a plurality of open-end spinning assemblies 501 arranged side by side, beneath whose debris-collecting openings 513 is disposed a stationary channel 516 extending along the length of the machine, beneath which channel a vacuum channel 537 is disposed. Openings 538 are provided at fixed intervals in the bottom of channel 516, to which openings the debris is pushed by a cleaning element 520, preferably in the manner shown in the embodiment of FIG. 2. Cleaning element 520 in this embodiment is mounted on a preferably adjustable cable conveyor 518 and can simultaneously clean guide surfaces 539, 540, which are swivelably mounted in the embodiment according to FIG. 5, so that they can follow the movement of cleaning element 520. A guide belt 541 runs inside vacuum channel 537, said guide belt being controllable so that it is synchronous with transport means 518. Control belt 541 is also provided with openings 542, which cooperate with openings 538 to provide an outlet from debris trough 516 into vacuum channel 537 when cleaning element 520 is in the vicinity of openings 538. As soon as cleaning element 520 leaves the vicinity of openings 538, the openings 542 provided in guide belt 541 also leave the vicinity of openings 538 so that the latter are closed.

Figure 6:
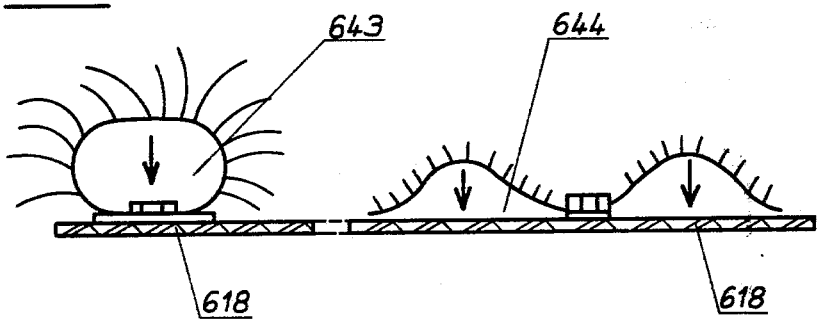
FIGS. 6 and 7 schematically show arrangements of cleaning elements assembled in groups, said elements being mounted on conveyor belts running along the spinning machine, constructed in accordance with other preferred embodiments of the invention.

FIG. 6 shows a tangential belt 618 similar to the arrangement in FIG. 4, on which belt cleaning elements 643, 644 are mounted, said elements consisting of flexible bodies and pressing lightly against the components of the spinning assembly in the direction shown by the arrow, during cleaning. In this manner, it is particularly easy to adjust cleaning devices 643, 644 to components of different shapes.

Figure 7:
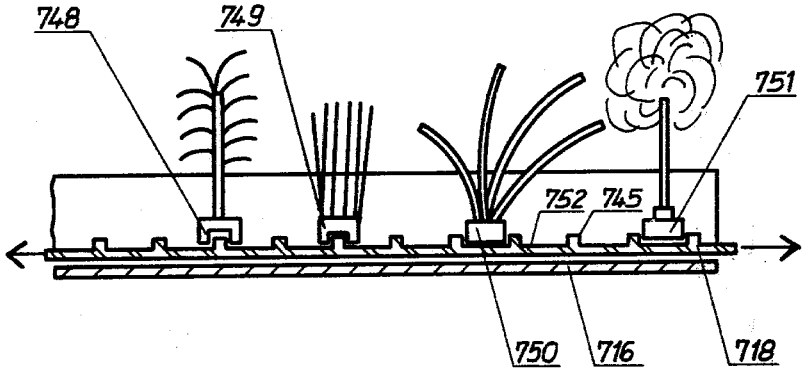

FIG. 7 again shows a stationary channel 716, along whose bottom a transport means 718, preferably adjustable, provided with projections 745, travels. The individual cleaning elements 748, 749, 750 and 751 are mounted in an especially easily interchangeable fashion by projections 745 and/or the chambers 752 formed thereby. These cleaning elements are all of different designs and can be deliberately adjusted to fit the surfaces to be cleaned. Of course, it is also contemplated in the embodiment according to FIG. 7 for the transport means 718 to simultaneously constitute the debris-collecting means, and to carry the debris along in the direction of movement.

Figure 8:
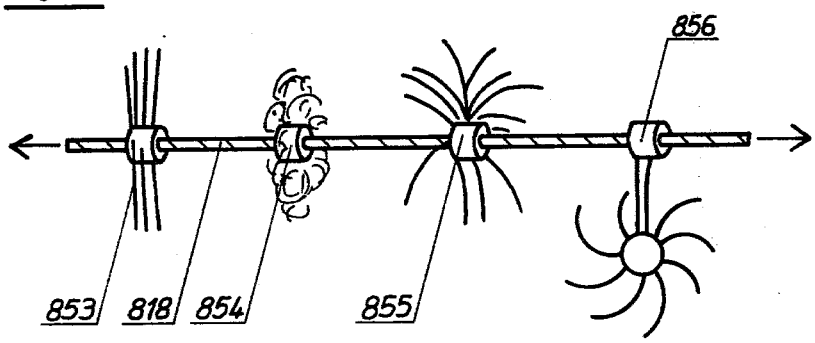
FIG. 8 schematically shows a group of cleaning elements disposed on a cable guide, constructed in accordance with another preferred embodiment of the invention.

FIG. 8 shows a transport means in the form of a cable conveyor 818, on which cleaning elements 853, 854, 855 and 856 are mounted serially and in groups, said elements being of different designs. These cleaning elements can serve simultaneously to clean the components of the spinning assemblies and to remove the debris collected in a stationary channel.

Figure 9:
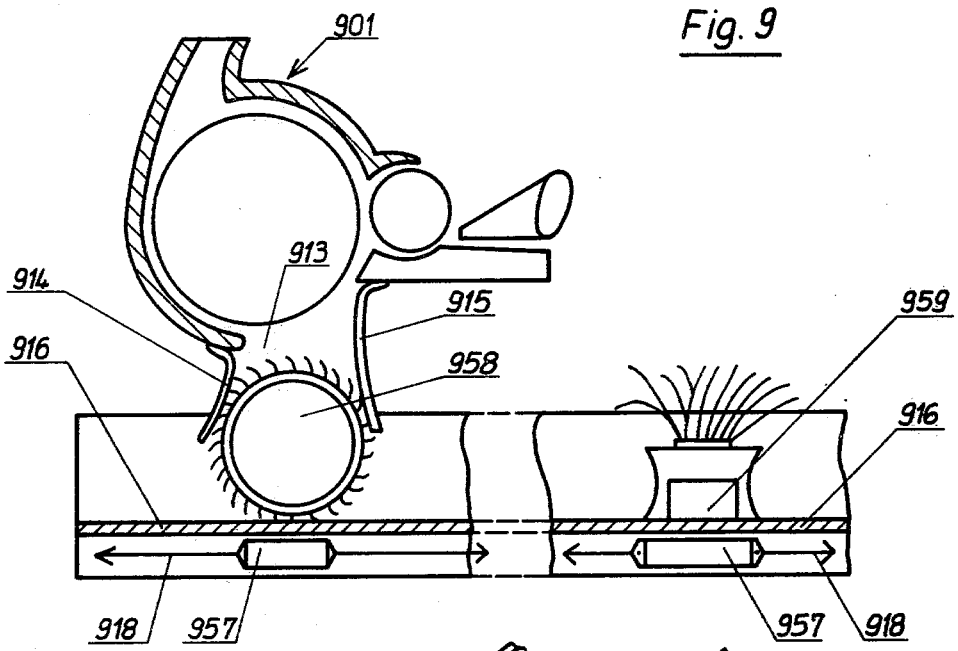
FIG. 9 is a schematic sectional view through an embodiment of the invention wherein cleaning elements are displaced in a channel serving to catch and remove debris, by means of magnets movable along the length of the machine.
Figure 9A:
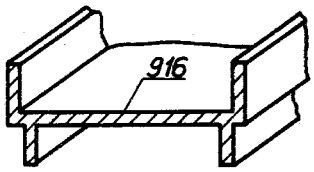

FIG. 9 shows a spinning assembly 901 in which the debris collected from a collecting opening 913 is collected in a stationary channel 916. The transport means for the cleaning elements in this case is a cable conveyor or a push rod 918 disposed beneath the bottom of channel 916, said conveyor or rod being provided with magnets 957 at fixed intervals. These magnets 957 are associated with cleaning elements 958, 959, the latter each containing an iron core or an iron jacket, so that they follow the longitudinal movement of magnets 957. The surfaces 914, 915 of spinning assemblies 901 are made flexible, for example of elastic plastic or spring strip. Cleaning elements 958, 959 are freely movable relative to channel 916. FIG. 9*a* shows how, in the embodiment according to FIG. 9, the cross section of channel 916 is shaped to provide an auxiliary channel for the cable conveyor and the magnets on its underside.

Figure 10:
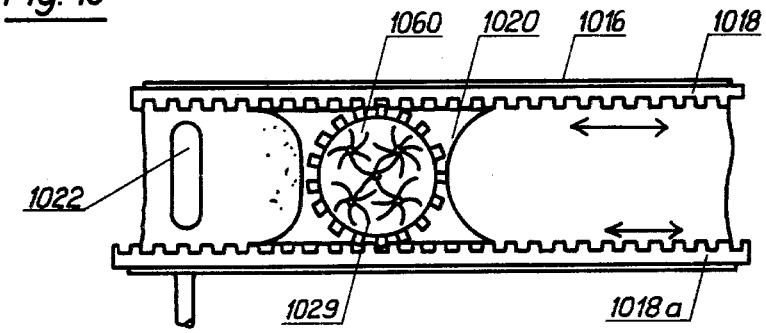
FIG. 10 is a top schematic view of a channel serving as means for catching and removing debris, with a scraper and with rotary brushes driven in a rotary motion disposed therein, constructed in accordance with another preferred embodiment of the invention.

The embodiment according to FIG. 10 is the same in principle as the embodiment in FIG. 3. Here again a stationary channel 1016 is provided, extending along the length of the machine, said channel containing an adjustable, displaceable cleaning carraige 1020 or a scraper. The debris collected in channel 1016 is pushed ahead of carriage 1020 until it is removed by the suction device through connections 1022. In this case, the transport means for the carriage is a toothed belt 1018, driven by a likewise toothed wheel 1060 meshing therewith, and thereby serving to provide the longitudinal movement of cleaning carriage 1020. Rotating wheel 1060 is provided with a plurality of additional cleaning elements 1029, which engage the assembly areas located above them and which are driven so that they rotate together with the wheel. The rotary movement and the direction of rotation can be influenced by a second toothed belt 1018*a* opposite the first, depending on which direction of movement or speed is selected.

Figure 11:
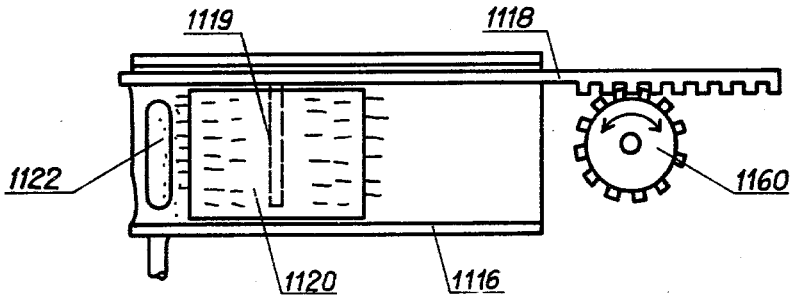
FIG. 11 is a top schematic view of a channel with a scraper which is movable back and forth by a rack drive, constructed in accordance with another preferred embodiment of the invention.

The embodiment shown in FIG. 11 likewise provides a stationary channel 1116, wherein the accumulated debris is guided to a suction device 1122 by a cleaning element 1120. The transport means for the cleaning element is an adjustable rack 1118, drivable by a pinion 1160. Cleaning element 1120 is easily releasable from a pusher 1119, mounted on rack 1118, and cleans not only channel 1116, but also the parts of one or more spinning assemblies located thereabove.

Figure 12:
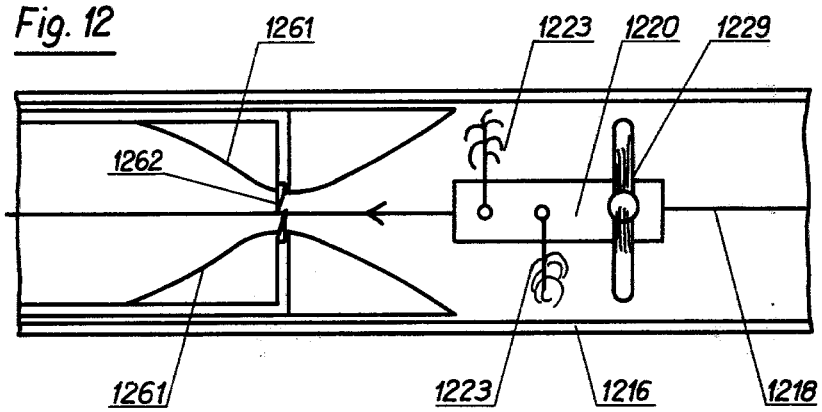
FIG. 12 is a top schematic view of an embodiment of the invention wherein a channel serving as a means for collecting and removing debris is provided with guiding surfaces for cleaning elements, said elements executing a feeding movement relative to the components to be cleaned.

Stationary channel 1216 shown in FIG. 12 is provided with a cable conveyor 1218 as a transport means for cleaning elements, said conveyor transporting the cleaning elements 1220 along the length of the machine, said elements being assembled into a group. This group is provided with cleaning elements 1223, 1229, swivelable at right angles to the direction of transport, said cleaning elements being deliberately adjustable with respect to certain points on the assemblies, and thereby carrying out a wiping action as they travel at right angles to the direction of transport. The preferred guide means is an elastic lip seal 1262, provided on the inwardly projecting guide surfaces 1261 of the channel, said surfaces swiveling the cleaning elements 1223, 1229 with respect to the components of the spinning assembly.

Figure 13:
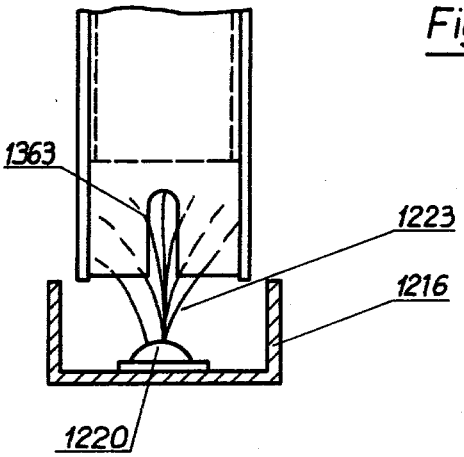
FIG. 13 is a sectional schematic view through a channel serving as a means for catching and removing debris, with a brush-like cleaning element, constructed in accordance with another embodiment of the invention.

FIG. 13 shows a cross section of channel 1216 in FIG. 12, wherein cleaning element 1220 is disposed in a lengthwise-displaceable manner. As a result of the arrangement of the guide surfaces of the channel shown in FIG. 12, individual cleaning elements 1223 may be adjusted so that they cooperate with a recess 1363 in one guide surface of the spinning assembly.

Figure 14:
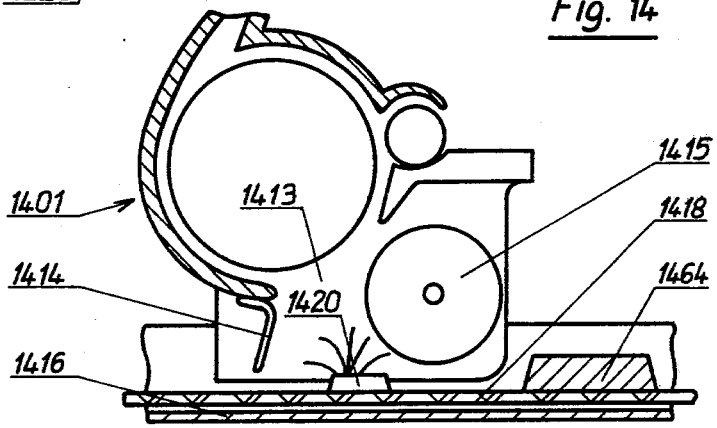
FIG. 14 is a sectional schematic view through a spinning assembly wherein a guiding surface limiting the collecting opening, constructed in accordance with another embodiment of the invention, is formed by the circumference of a roller.

Spinning assembly 1401 in FIG. 14, in addition to a guide surface 1414 made of elastic material, is provided with a guide surface made in the form of a rotatable roller 1415. This roller is rotated by a rubber pusher 1464 of a transport means 1418, displaceable lengthwise in channel 1416, said pusher being turned a certain amount during each pass. A cleaning element 1420 then removes debris from this rotated guide surface of roller 1415. Of course, transport means 1418 in this embodiment can also serve simultaneously as a debris-collecting means.

Figure 15:
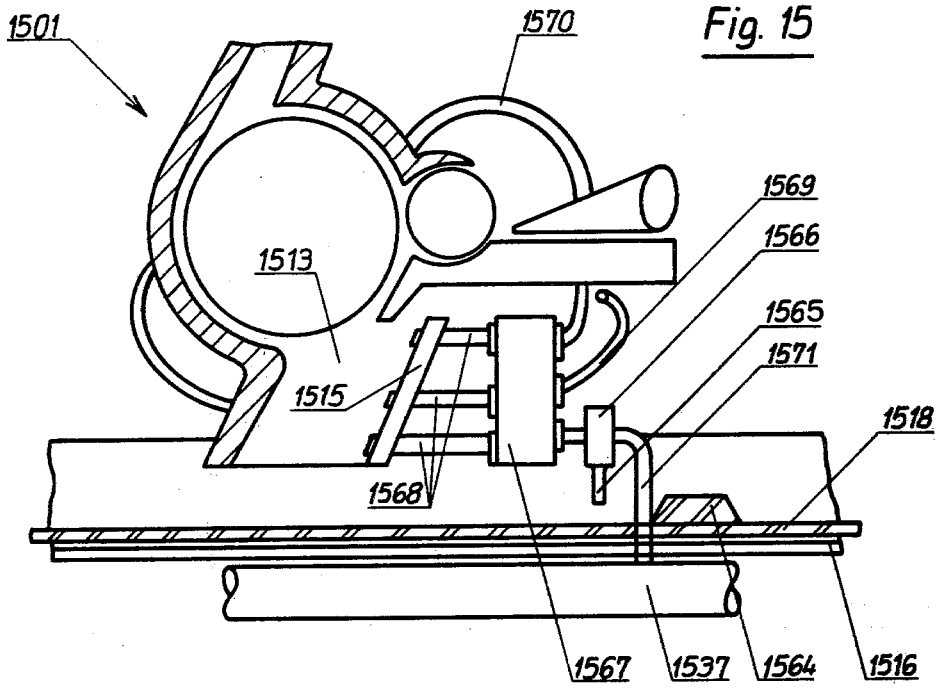
FIG. 15 is a schematic sectional view through an embodiment of the invention wherein each spinning assembly is equipped with stationary suction and/or blast nozzles.

In the spinning assembly 1501 according to FIG. 15, a tangential belt 1518 is mounted lengthwise displaceably beneath collecting opening 1513 and serving preferably as a debris-collecting means. However, tangential belt 1518 can serve alternately as a simple pulling element in a channel 1516 and may be lengthwise-displaceable. In this embodiment the cleaning elements are disposed in a stationary manner at each spinning station 1501. Each spinning station 1501 is connected to a vacuum or pressure line 1537 through a suction line and/or compressed air line 1571. Line 1571 terminates in a manifold 1567, from which individual lines 1568, 1569, and 1570 run to the points on the spinning assembly which must be given particular cleaning. The individual lines terminate in suction or blast nozzles. A valve 1566 is disposed between manifold 1567 and line 1571, said valve being provided with a presser 1565, actuable by a cam 1564 mounted on tangential belt 1518. A controlled cleaning action can be produced by this control cam 1564 movable along the length of the machine when valve 1566 is actuated at each spinning station 1501. This arrangement has the advantage that the air lines can be brought to positions on spinning assembly 1501 such that they can no longer be reached by mechanical cleaning elements.

Figure 16:
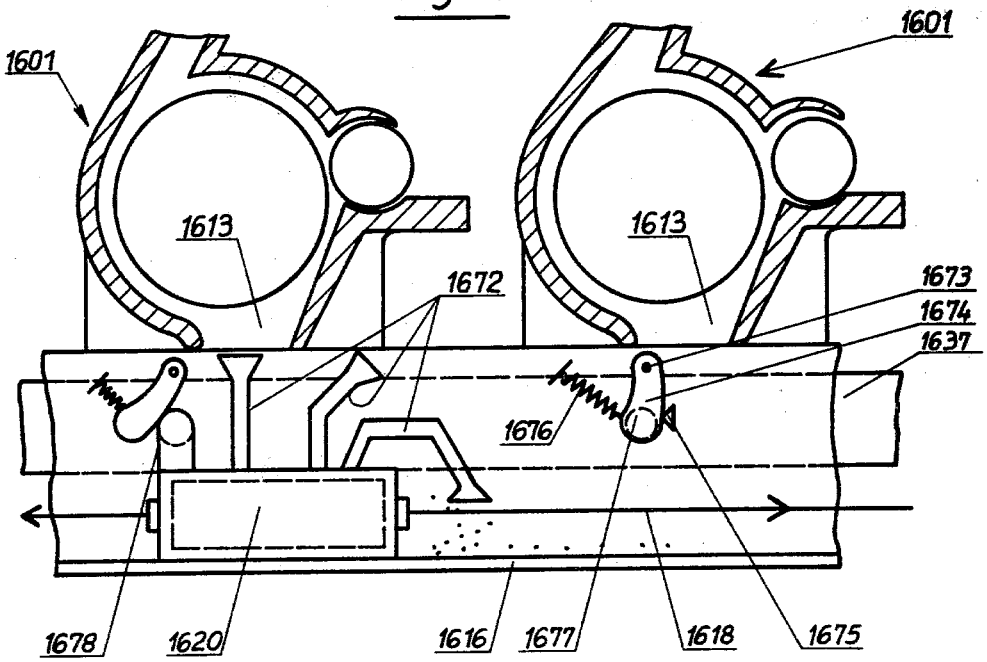
FIG. 16 is a schematic sectional view through an embodiment of the invention wherein a traveler equipped with suction and/or blast nozzles is disposed within a channel serving as a means for collecting debris.

In the embodiment shown in FIG. 16, the open-end spinning assembly 1601 and/or its collecting openings 1613 are again associated with a stationary channel 1616 extending along the length of the machine. A pneumatic traveler 1620 is provided, said traveler being displaceable and serving as a transport means moved by a cable conveyor 1618, said traveler being equipped with cleaning elements. It is provided with suction and/or blast nozzles 1672, said nozzles being associated both with the individual components and especially with the guide surfaces of the spinning assemblies 1601 and channel 1616. A vacuum and/or pressure channel 1637 is provided to the side of channel 1616, said channel 1637 being connectable to pneumatic traveler 1620 through connecting openings 1677. In the normal case, connecting openings 1677 are closed by a closing element 1674, said element being swivelable about an axis 1673 against the pressure of a spring 1676. In the closed position, sealing element 1674 rests against a stop 1675. Traveler 1620 can push sealing element 1674 away by a tubular extension 1678, whereby it is temporarily connected to connecting openings 1677. In this manner, the corresponding spinning assembly 1601 may be cleaned. The traveler is preferably provided with an independent drive. The traveler can push the debris in channel 1616 ahead of itself until it reaches a connection to a suction device. However, it is also contemplated for the traveler to be designed, especially if the connecting openings 1677 lead to a suction device, for at least one of cleaning elements 1672 to be directed toward the bottom of the channel and to draw up the collected debris if there is a connection to the connecting opening. The traveler can also be provided with mechanical cleaning elements such as brushes or the like according to other contemplated embodiments. The brushes can be driven by a rotary drive actuated by a vacuum or by compressed air.

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Apparatus for removing debris from an open-end spinning machine of the type having a plurality of spinning assemblies arranged side by side with each of said spinning assemblies having shedding devices for shedding debris from fibrous material prior to introduction of the fibrous material to spinning rotor means to be spun; said apparatus comprising:

collecting openings at each of said spinning assemblies permitting egress of debris away from the shedding devices, a stationary debris collecting channel extending along said spinning machine in open facing relationship to said collecting openings, a plurality of channel openings disposed along the channel for accommodating removal of debris from the channel, said channel openings being spaced from one another by a distance greater than the width of a single spinning assembly, debris transport means movably disposed in said channel for transporting the debris from adjacent the respective collecting openings to the respective channel openings, and suction applying means and suction connection means at said channel openings communicating said channel openings with the suction applying means.

2. Apparatus according to claim 1, wherein suction connection control means are provided for intermittently opening and closing the suction connection means.

3. Apparatus according to claim 1, wherein each of the suction connection means is provided with a sealing element, and wherein the debris transport means includes means for opening the sealing element.

4. Apparatus according to claim 1, wherein the suction control means are actuatable in dependence on the position of the debris transport means along the length of the channel.

5. Apparatus according to claim 1, wherein said debris transport means includes a brush engageable with the bottom of the channel.

6. Apparatus according to claim 1, wherein said debris transport means includes a scraper engageable with the bottom of the channel.

7. Apparatus according to claim 1, wherein component cleaning means are provided for cleaning portions of the spinning assemblies in the area of the shedding devices and collecting openings.

8. Apparatus according to claim 7, wherein at least part of said component cleaning means are carried by the debris transport means.

9. Apparatus for removing debris from an open-end spinning machine of the type having a plurality of spinning assemblies arranged side by side with each of said spinning assemblies having shedding devices for shedding debris from fibrous material prior to introduction of the fibrous material to spinning rotor means to be spun; said apparatus comprising:

collecting openings at each of said spinning assemblies permitting egress of debris away from the shedding devices, a stationary debris collecting channel extending along said spinning machine in open facing relationship to said collecting openings, a plurality of channel openings disposed along the channel for accommodating removal of debris from the channel, said channel openings being spaced from one another by a distance greater than the width of a single spinning assembly, openings with the suction applying means.

10. Apparatus for removing debris from an open-end spinning machine of the type having a plurality of spinning assemblies arranged side by side with each of said spinning assemblies having shedding devices for shedding debris from fibrous material prior to introduction of the fibrous material to spinning rotor means to be spun; said apparatus comprising:

collecting openings at each of said spinning assemblies permitting egress of debris away from the shedding devices, a stationary debris collecting channel extending along said spinning machine in open facing relationship to said collecting openings, a plurality of channel openings disposed along the channel for accommodating removal of debris from the channel, said channel openings being spaced from one another by a distance greater than the width of a single spinning assembly, and debris transport means movably disposed in said channel for transporting the debris from adjacent the respective collecting openings to the respective channel openings, wherein component cleaning means are provided for cleaning portions of the spinning assemblies in the area of the shedding devices and collecting openings, and wherein said component cleaning means includes:

fluid pressure applying means disposable in the area of the shedding devices and collecting openings, and control means for selectively actuating the fluid pressure applying means to clean portions of the spinning assemblies in the area of the shedding devices and collecting openings.

11. Apparatus according to claim 10, wherein said control means are actuable in dependence on the position of the debris transport means along the length of the channel.

12. Apparatus according to claim 11, wherein said fluid pressure applying means includes vacuum suction means and blowing means operable to clean respective different areas of the spinning assemblies.

13. Apparatus according to claim 12, wherein said fluid pressure applying means are carried by the debris transport means.

14. Apparatus according to claim 9, wherein the cleaning element means are provided with adjusting means for adjusting their respective positions with respect to the positions of the spinning assemblies to be cleaned.

15. Apparatus according to claim 9, wherein the cleaning element means are carried on the debris transport means.

16. Apparatus for cleaning an open-end spinning machine of the type having a plurality of spinning assemblies arranged side by side with each of said spinning assemblies including respective shedding devices and collecting openings, the shedding devices including means for shedding debris from fibrous material prior to introduction of the fibrous material to spinning rotor means to be spun, the collecting openings being disposed to accommodate egress of the debris from the shedding devices; said apparatus comprising:

first cleaning element means for cleaning respective first portions of the spinning assemblies in the area of the shedding devices and collecting openings, second cleaning element means for cleaning respective second portions of the spinning assemblies in the area of the shedding devices and collecting openings, and cleaning element support means for detachably supporting the first and second cleaning element means as a unit, wherein said first and second cleaning element means are separate from and differently configured from one another to accommodate cleaning of differently configured portions of the spinning assembly.

17. Apparatus according to claim 16, wherein the cleaning element means are provided with adjusting means for adjusting their respective positions with respect to the portions of the spinning assemblies to be cleaned.

18. Apparatus according to claim 16, wherein said cleaning element means are carried on a movable transport device so as to be sequentially adjacent different ones of the spinning assemblies.

19. Apparatus according to claim 18, wherein said transport device includes a brush which engages the bottom of a channel to move debris therealong, and wherein the cleaning element means are attached to and carried with the brush.

20. Apparatus according to claim 18, wherein said transport device includes a scraper which engages the bottom of a channel to move debris therealong, and wherein the cleaning element means are attached to and carried with the scraper.

21. Apparatus according to claim 18, wherein said transport device includes a belt movable along the spinning machine.

22. Apparatus according to claim 16, wherein the portions of the spinning assembly to be cleaned by the cleaning element means are made flexible and/or mounted flexibly.

23. Apparatus for cleaning an open-end spinning machine of the type having a plurality of spinning assemblies arranged side by side with each of said spinning assemblies including respective shedding devices and collecting openings, the shedding devices including means for shedding debris from fibrous material prior to introduction of the fibrous material to spinning rotor means to be spun, the collecting openings being disposed to accommodate egress of the debris from the shedding devices; said apparatus comprising:

fluid pressure applying means disposable in the area of the shedding devices and collecting openings, and control means for selectively actuating the fluid pressure applying means to clean portions of the spinning assemblies in the area of the shedding devices and collecting openings, and wherein said control means are actuable in dependence on the position of a debris transport means along the length of a channel facing the collecting openings.

24. Apparatus for cleaning an open-end spinning machine of the type having a plurality of spinning assemblies arranged side by side with each of said spinning assemblies including respective shedding devices and collecting openings, the shedding devices including means for shedding debris from fibrous material prior to introduction of the fibrous material to spinning rotor means to be spun, the collecting openings being disposed to accommodate egress of the debris from the shedding devices; said apparatus comprising:

fluid pressure applying means disposable in the area of the shedding devices and collecting openings, and control means for selectively actuating the fluid pressure applying means to clean portions of the spinning assemblies in the area of the shedding devices and collecting openings, and wherein said fluid pressure applying means includes vacuum suction means and blowing means operable to clean respective different areas of the spinning assemblies.

25. Apparatus according to claim 24, wherein the fluid pressure applying means are carried on a movable transport device to accommodate sequential cleaning of a plurality of spinning assemblies.

26. Apparatus according to claim 25, wherein the spinning assemblies and the transport device include interengageable cam means for controlling the pressure in the fluid pressure applying means.

27. Apparatus according to claim 25, wherein the transport device is selectively connectible in the vicinity of the spinning assemblies with suction and/or compressed air sources.

* * * * *